US005865313A

United States Patent [19]

Huang et al.

[11] Patent Number: 5,865,313

[45] **Date of Patent: *Feb. 2, 1999**

[54] PLASTIC BAG PACK SYSTEM WITH NOVEL HANDLE APERTURES

[75] Inventors: Frank Feng Jung Huang; Daniel Huang, both of Tustin, Calif.

[73] Assignee: Durabag Co., Inc., Tustin, Calif.

[ * ] Notice: The term of this patent shall not extend beyond the expiration date of Pat. No. 5,695,064.

[21] Appl. No.: 866,815

[22] Filed: May 30, 1997

Related U.S. Application Data

[63] Continuation of Ser. No. 566,704, Dec. 4, 1995, abandoned.

[51] Int. Cl.[6] ..... B65D 33/14

[52] U.S. Cl. ..... 206/554; 383/9

[58] Field of Search ..... 206/554; 383/7, 383/9

[56] References Cited

U.S. PATENT DOCUMENTS

| | | | |
|---|---|---|---|
| Re. 33,264 | 7/1990 | Baxley et al. | 206/554 |
| 4,981,216 | 1/1991 | Wilfong, Jr. | 206/554 |
| 5,269,605 | 12/1993 | Nguyen | 206/554 |
| 5,307,935 | 5/1994 | Kemanjian | 206/554 |
| 5,335,788 | 8/1994 | Beasley et al. | 206/554 |
| 5,346,310 | 9/1994 | Nguyen | 206/554 |
| 5,363,965 | 11/1994 | Nguyen | 206/554 |
| 5,469,969 | 11/1995 | Huang | 206/554 |
| 5,469,970 | 11/1995 | Li | 206/554 |
| 5,507,713 | 4/1996 | Glod, Sr. et al. | 206/554 |
| 5,561,967 | 10/1996 | Nguyen | 206/554 |
| 5,695,064 | 12/1997 | Huang et al. | 206/554 |

*Primary Examiner*—Jim Foster

*Attorney, Agent, or Firm*—Daniel R. Kimbell

[57] ABSTRACT

A pack of plastic bags for use with a bagging rack. Each plastic bag in the pack of bags has a central tab portion between its two upwardly extending handles, which are at the sides of the mouth of the T-shirt bags. "J"-shaped slits are formed in the handles for carrying them on a bagging rack. A central tab portion is located on the front and rear walls above the mouth region of the plastic bags. The central tab portion has an aperture for receiving a retaining hook of a bagging rack, and a central tab slit which extends across the central tab portion, except for uncut portions near side edges of the central tab. The tearing cuts pass through the stack of bags and follow a non-straight path. The pack of plastic bags is preferably formed from plastic material which has been exposed to corona surface treatment. Frangible pressure bonding can be formed along the bottom side of said tearing cut to provide a self-opening feature. When the top bag is removed from the bagging rack, the next bag in the pack of bags will self-open into a open position for loading with merchandise.

30 Claims, 3 Drawing Sheets

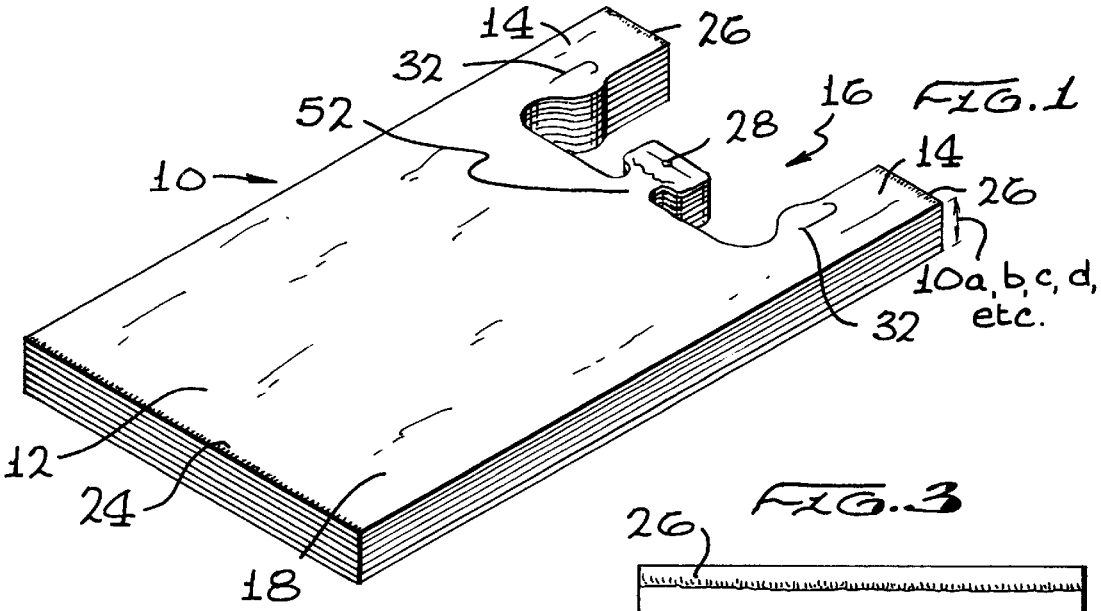
FIG. 1
FIG. 3
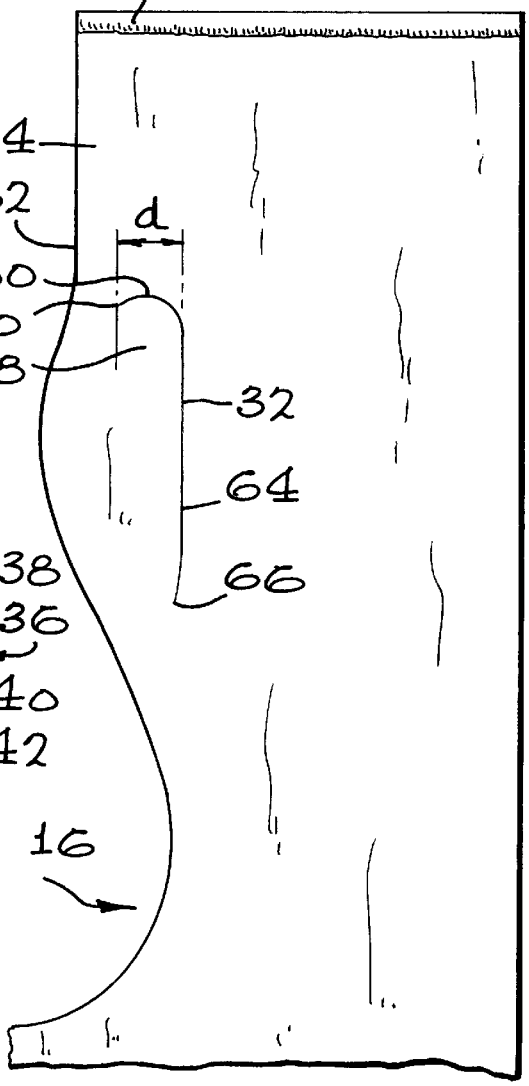
FIG. 2
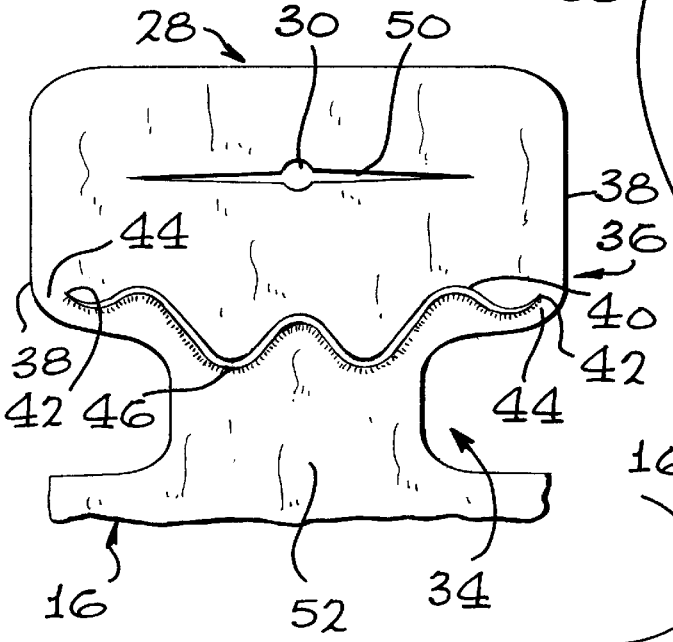

PLASTIC BAG PACK SYSTEM WITH NOVEL HANDLE APERTURES

This application is a continuation of application Ser. No. 08/566,704 filed Dec. 4, 1995 which application is now abandoned.

BACKGROUND OF THE INVENTION

1. Field of the Invention

This invention relates to plastic bags, and more particularly to a pack of T-shirt bags, merchandise bags, trash bags, and the like made preferably of polyolefins, and method of manufacturing same, which can be used with a variety of different sized bagging racks.

2. Description of the Prior Art

Since the mid-1980's, the use of plastic shopping bags has grown dramatically due to the great advantage plastic bags have over bags made of other materials, such as paper. Plastic bags are typically made of low or high density polyethylene (LDPE and HDPE, respectively), but can be made of any of the polyolefins. LDPE and HDPE bags are stronger, lighter and much more compact than paper bags when stacked, saving valuable storage space at the merchants' checkout counter and storage areas. These attributes also make these bags less expensive to transport. LDPE and HDPE bags can be manufactured and sold much less expensively than competing paper bags, making them the bags of choice for merchants. LDPE and HDPE bags are also environmentally friendly since they require 70 percent less energy to manufacture than competing paper bags and are readily recyclable, and when not recycled, are non-toxic when incinerated or disposed of in landfills.

Many groceries stores and other merchants now use a style of plastic bag to bag groceries called T-shirt bags. T-shirt bags are pleated bags which are closed, by heat sealing, at a bottom edge, and have a pair of integral handles extending upwardly to define an open mouth of the bag therebetween. The handles allow the grocery loaded bags to be more easily carried. Because high density polyethylene (HDPE) has a greater resistance to stretching and deformation, HDPE is generally used for making T-shirt bags, although LDPE and other polyolefins can also be used. T-shirt bags are normally provided in packs of aligned bags and these packs of bags are generally carried on a bagging racks for easy loading of the bags.

T-shirt bags are generally manufactured by the following process. A continuous tube of HDPE, LDPE, LHDPE, or some combination of these and other plastic materials having the desired color, thickness, diameter, and physical qualities such as tensile strength, stretch and tear resistance, is formed on a extruding machine. The continuous plastic tube is then passed over rollers to roll the continuous plastic tube onto a spool. Depending on whether or not the bags to be formed from the continuous tube of HDPE will be printed on one or both sides, the newly formed continuous tube may be subjected to corona surface treatment, wherein the side or sides of the continuous flattened tube of plastic which are to be later printed will be passed by high voltage corona discharge electrodes. Corona surface treatment affects electrical and chemical changes on the plastic's outer surface to prepare that surface of the bag for printing. Corona surface treatment also contributes to creating frangible pressure bonding and the reliable self-opening operation of the instant plastic bag pack system of the invention.

After being corona surface treated and rolled, the roll of continuous plastic tube is typically pleated on two sides in order to double from two to four the number of layers of plastic material on two side regions of the pleated roll. (The handles of the assembled bags are latter cut into this double thick side regions for added strength). A bagging machine is used to heat seam close and cut individual the pleated tubes into sections having a desired length, with the cut sections of the pleated tube at top and bottom edges forming closed and flattened pleated bags of a desired length and width (sometimes referred to as "pillowcases"), with the pleated sides being at both sides of the flatted pleated bags. Further downstream of the heat seaming and cutting step, the bags are stacked in aligned piles. Thereafter, a hydraulic die or other cutting method or tool is utilized to remove material at the stacked bags' top portion to form the handles and a central tab portion with a central tab slit for support of the pack of bags on a hook of a bagging neck and a tearing line below the central tab slit. Usually a heat weld is utilized to hold the stack of central tabs together, thus forming a pack of bags. Each handle will comprise four layers of material since they are cut out from the pleated side portions of the bag. This not only makes the handles stronger, but also thicker, and more comfortable to hold.

Despite the many advantages HDPE T-shirt bags have over paper bags, unlike thicker and stiffer paper bags with a discreet flat bottom, they are not self-standing. This is due to their relatively thin and flexible material. In grocery stores settings, where quick and easy loading of bags is desirable, T-shirt bags are provided in stacks or packs which are generally supported on a bagging rack as merchandise is loaded into the bags to overcome the lack of self-standing ability.

There are several popular styles of T-shirt bags available in packs of bags and bagging racks for use therewith, some main types of which will be discussed. In one type of pack of T-shirt bags and bagging racks used therewith, the bagging rack has a support base, a wire rear wall with a tab receiving hook, and two wire arms extending forwardly over the base. In the center top portion of the arms, the wire is formed so as to have a section which will spread and hold apart the handles of T-shirt bags engaged therewith to open up the mouth of the T-shirt bag. The pack of T-shirt bags used with these styles of bagging racks consists of a stack of overlapped and aligned bags which have a lower bag portion with two handles extending upwardly at both sides of the mouth of the bag. A central tab portion is provided on the mouth of the bags between the two handles, and the central tab portions of the pack of bags are heat-sealed together. The heat sealed central tabs thus form a stack or book of central tabs and have a central tab slit formed therethrough. The central tab slit is engaged with the tab receiving hook on the rear wall of the bagging rack, and the book of central tabs will remain engaged therewith, even after individual bags are removed. Below the central tab slit a tearing slit is provided which traverses almost the entire distance of the central tabs except for a small distance at both sides of the central tab portion. The tearing slit allows the individual bags to be torn off the pack of bags as they are needed, and looped onto the bagging rack.

A second major type of pack of T-shirt bag, and bagging rack designed to be used therewith, are disclosed in U.S. Pat. No. RE 33,264 to Baxley, et al. Another version of this style of bagging rack is disclosed in U.S. Pat. No. 4,840,336 to Stroh, et al. Both of these bagging racks have a bottom support base and a rear wire wall with a tab receiving hook located thereon. However, to open up each individual bag for loading, instead of looping the handles of the bags over the top of the support arm one at a time, as is done with the first type of pack of bags and rack, these racks have two handle support rods extending forwardly from the rear wire wall of the rack. The pack of T-shirt bags used with these styles of racks are similar to those used with the first type of rack, except that aligned, inverted horseshoe-shaped aperture s are formed on each handle of the pack of bags, through which pass the handle support rods of the bagging rack. In these prior art inverted horseshoe-shaped apertures, the cut ends are turned inwardly and upwardly. The theory behind the prior art inverted horseshoe-shaped handle aperture cut is that any slit or cut in a bag is a potential tear and rip initiation point, which can damage the integrity of the bag. By using an inverted, horseshoe shaped handle aperture cut with turned up and in ends, any potential tearing at the ends will tend to be propagated inwardly and upwardly, into the flap formed by the cut, which it is harmless. While inverted horseshoe shaped handle apertures do accomplish the intended purpose, they reduce the effective, continuous width of the handles and can somewhat weaken the handles. The longer the horseshoe, the weaker the bag handles become.

Despite the attempts to overcome the problems associated with these presently available T-shirt bags, there continues to remain a need for an improved pack of T-shirt bags which can be used with a variety of bagging racks, which is easily manufactured, and which is strong.

SUMMARY OF THE INVENTION

The present invention overcomes the above noted deficiencies of the presently available T-shirt bags by providing a new type of T-shirt bag which can be readily used with a variety of different bagging racks.

The invention provides a pack of bags for use with a variety of different sized bagging racks, comprising:

a plurality of bags, each of said bags having opposed walls with outer surfaces, and each bag being aligned in a stack, said opposed walls being closed at a bottom edge and at least partially openable at a top region to define a mouth region;

a central tab portion being located on said opposed walls of each of said bags and extending above said mouth region of said bags, said central tab portion having a central tab slit extending thereacross except for uncut portions near side edges of said central tab portion, said tearing cuts being formed through said stack of bags;

a pair of handles extending upwardly from both sides of the mouth, each of said handles having an inverted "J"-shaped handle aperture formed therethrough for use in mounting the bag pack on a bagging rack.

The invention further provides a pack of self-opening bags for use with a variety of bagging racks, comprising:

a plurality of bags, each bag having a front wall and a rear wall;

side walls joining said front and rear walls, said bags having a bottom edge which is closed and a partially opened top edge;

a pair of integral handles extending upwardly from said top edge with a mouth region located between said integral handles, said integral handles having elongate, inverted "J"-shaped apertures formed therethrough; and central tab portions located on said front and rear walls in said mouth region of said bags, said central tab portions having a neck region which extends above said mouth region and a head region which extends above said neck region, an aperture for receiving a retaining hook of a bagging rack, and a central tab slit which extends across said central tab portion in an interface region between said neck region and said head region, except for uncut portions adjacent said side edges of said central tab portion, said central tab slit being located below said aperture, said pack of bags being frangibly bonded together along the bottom edge of said central tab slit which pass through said central tab portions.

BRIEF DESCRIPTION OF THE DRAWINGS

FIG. 1 is a perspective view of a pack of bags of the invention.

FIG. 2 is a fragmentary view of the central tab area of the pack of bags of FIG. 1, showing frangible bonding adjacent a sinusoidal central tab slit.

FIG. 3 is a detail showing the inverted "J"-shaped handle aperture in the handle of the bag pack.

DESCRIPTION OF THE PREFERRED EMBODIMENT

Figure 4:
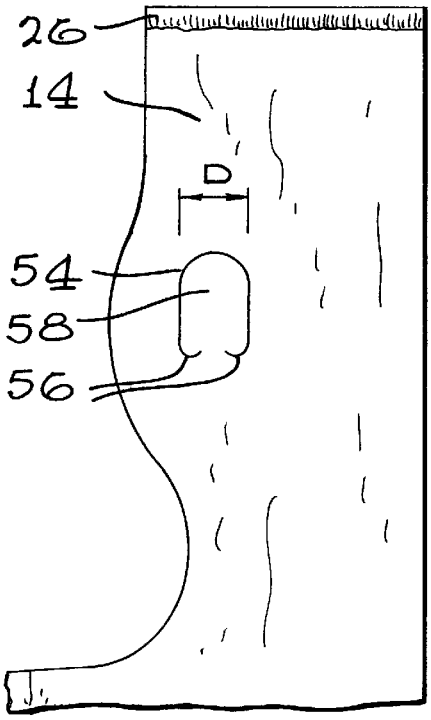
FIG. 4 PRIOR ART
FIG. 4 is a top plan view of a prior art, inverted horseshoe-shaped handle aperture formed in the handles.
Figure 5:
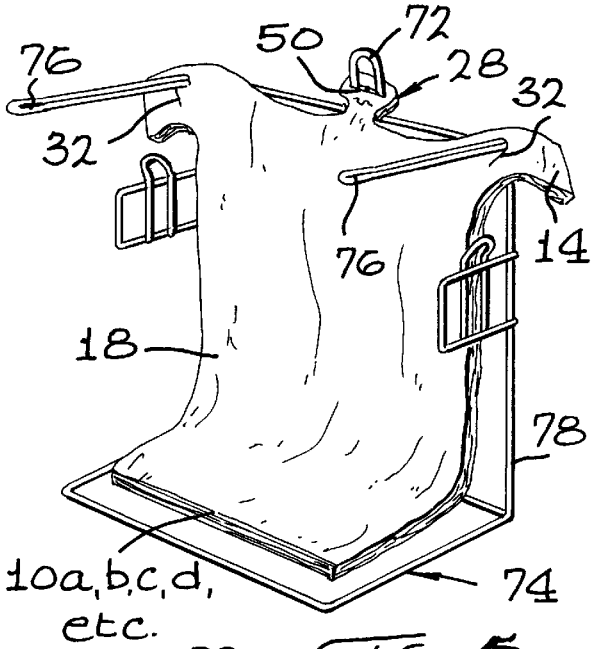
FIG. 5 is a perspective view of the pack of bags of FIG. 1 hanging on a bagging rack, before the front bag is readied for loading.
Figure 6:
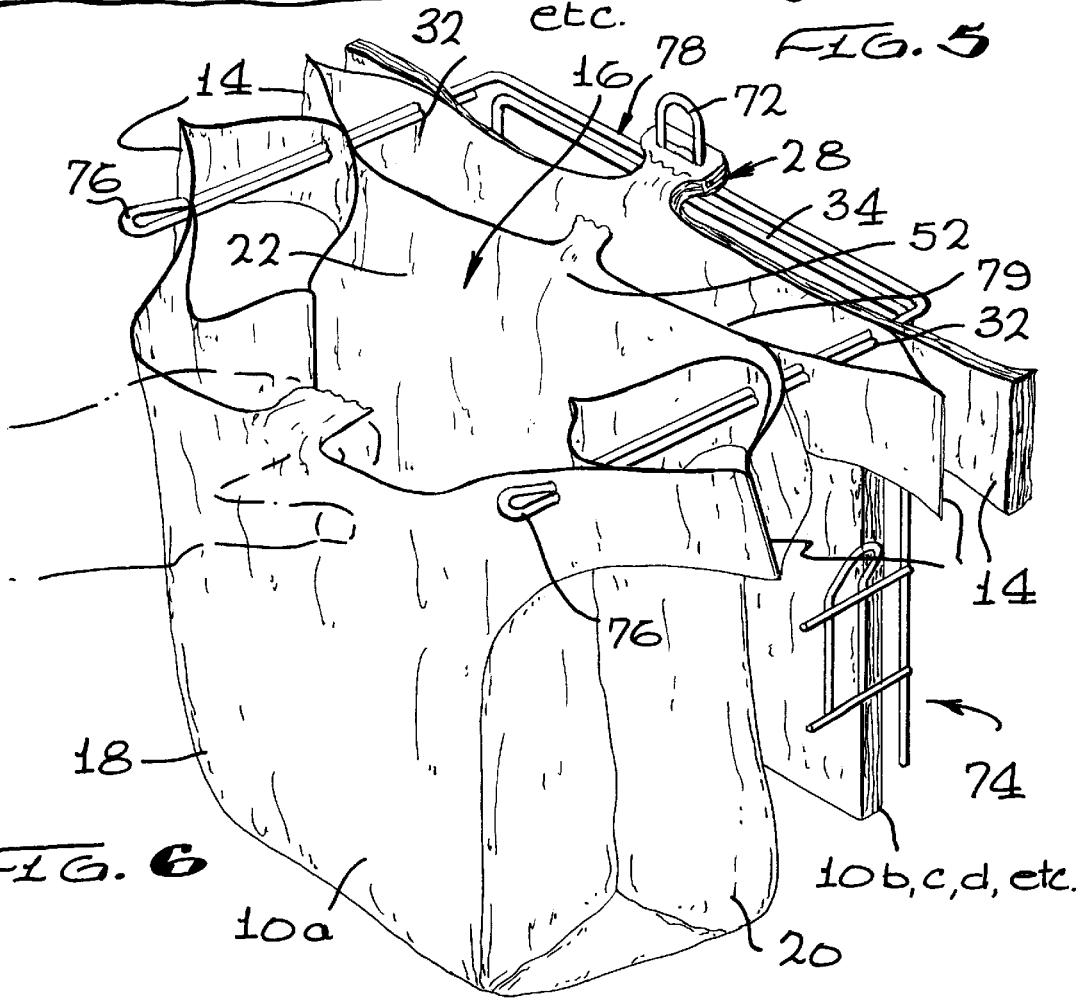
FIG. 6 is a front perspective view of a bag being pulled forward from the pack of bags on the bagging rack of FIG. 6.

Referring now to the drawings, there is illustrated in FIGS. 1–6 various views of the pack of T-shirt bags of the instant invention. As shown in FIGS. 1, 3 and 6, the pack of plastic T-shirt bags 10*a, b, c, d,* etc. consists of a stack of overlapped bags 10*a,* 10*b,* 10*c,* 10*d,* etc., each of which has a lower bag portion 12 with two handles 14 extending upwardly from the lower bag portion 12 at both sides of the mouth 16 of the bags 10*a, b, c, d,* etc. The individual bags 10*a, b, c, d,* etc. have a front wall 18, preferably pleated side walls 20 and a rear wall 22. Each of the T-shirt bags 10 of the invention are heat seamed together at their bottom edges 24 and at the top edges 26 of their handles 14. Apertures, such as in the shape of inverted "J"-shaped slits 32, are formed in the handles 14. A central tab portion 28 extends above the mouth 16 of the bags 10*a, b, c, d,* etc. between the two handles 14. Referring to FIG. 2, a detail of the central tab portion 28 is shown. The central tab portions (or central tab regions) 28 are preferably heat welded together at 30. The heat sealed 30 central tab portions 28 thus form a stack or "book" of aligned central tab portions 28. Hereinafter, the term "central tab portion" and "central tab region" 28 may sometimes be used interchangeably.

The central tab portion 28 has a neck region or portion 34 and a head region or portion 36. If desired, the neck region 34 can be made narrower than the head region 36. Located at the interface region between the neck region 34 and the head region 36 is a central tab slit 40 which extends through the stack of bags 10*a, b, c, d,* etc., between terminal points 42 near the side edges 38 of the central tab portion 28. Uncut areas of material 44 remain between the terminal ends 42 of the central tab slit 40 and the side edges 38. The inventor has found that an uncut area 44 of about 1 to 3 millimeters is ideal. If a self-opening feature of the bag pack 10*a, b, c, d,* etc. is desired, an area of frangible cold pressure bonding ("central tab slit bonding") 46 can be formed on the lower edge of the central tab slit 40 to extend through the stack of bags 10*a, b, c, d,* etc. A mounting aperture 50 is formed above the central tab slit 28 in the head region 36 of the central tab portion 28. The heat weld 30 is shown as passing through the central mounting tab 28 above the mounting aperture 50, but can be formed anywhere above the central tab slit 40.

In the embodiment of FIG. 2, the central tab slit 40 follows a sinusoidal path, which is longer in length than the straight line distance between its two endpoints 40. A straight, a downwardly curved, or other shaped cut cuts can also be utilized. The advantage of having the central tab slit 40 have a longer than straightline distance between its end points is twofold. First, it allows a longer length of frangible bonding 46 to be formed. Second, it results in a relaxation of bag tension below the central tab slit 40 in area 52.

Referring to FIG. 3, the inverted "J"-shaped handle apertures 32 have benefits not found with prior art inverted horseshoe shaped handle apertures 54, such as shown in FIG. 4. In these prior art apertures 54, the cut ends 56 are turned inwardly toward each other and upwardly. The theory behind the prior art inverted horseshoe-shaped handle aperture cut 54 is that any slit or cut in a bag is a potential tear and rip initiation point, which can damage the integrity of a bag. By using an inverted, horseshoe shaped handle aperture cut 54 with turned up and in ends 56, any potential tearing at the ends 56 will tend to be propagated inwardly and upwardly, into the flap 58 formed by the cut 54, which is harmless. The width of the prior art inverted horseshoe shaped handle apertures 54 is depicted as being "D" wide. While these prior art inverted horseshoe-shaped handle apertures 54 do accomplish the intended purpose, they reduce the effective, continuous uncut width of the handles 14.

Referring again to FIG. 3, the inventors have found that by using an inverted "J"-shaped handle aperture slit 32, the strength of the bag handles 14 is not substantially compromised. In fact, bags with these apertures are just as strong or even stronger than bags with inverted horseshoe-shaped handle apertures. The upper end 60 of the "J"-shaped apertures 32 curves toward the inner side edges 62 of the handles 14 from a relative straight portion 64 with an uncurved bottom end 66. The straight portion 66 is preferably angled slightly inwardly toward the inner side edge 62 of the handles 14. The tangent to the upper curved end 60 is at its terminal and 70 either directed generally horizontally, or slightly downwardly. The width "d" of the aperture slit need not be very wide since the bag material between the endpoints 66 and 70 can be pushed aside easily pushed aside easily when the bag pack 10*a, b, c, d,* etc. is loaded on a bagging rack to permit easy placement of the pack of bags 10*a, b, c, d,* etc. Moreover, by using a "J"-shaped aperture 32 with a relatively long cut portion 64, the bag pack 10*a, b, c, d,* etc. can be used on a greater variety of racks, having different spacings between their support arms.

Referring to FIGS. 5 and 6, the pack of bags 10*a, b, c, d,* etc. is carried in its mouth region 16 by the mounting aperture 50 of its central tab portion 28 being hooked on a central mounting tab hook 72 of a bagging rack 74. In this embodiment of the bagging rack 74, the handles 14 are carried on forwardly extending support arms 76 of the bagging rack 74, which arms 76 pass through the handle apertures 32 to support the handles 14. The central mounting hook 72 is mounted on a rear wall 78 of the bagging rack 74. As stated above, by utilizing "J"-shaped aperture 32 in the handles 14 with a relatively long cut portion 64, the pack of bags 10*a, b, c, d,* etc. is easily loaded on a variety of different racks.

The individual bags 10*a, b, c, d,* etc. of the bag pack are formed from a continuous tube of plastic material which is preferably treated on its outside surface by corona surface treatment. Equipment such as that offered by Kasuga Denki Co., Ltd., of Tokyo, Japan, can be used. The corona surface treatment affects the changes to the outer surface of the continuous tube of plastic material used to form the pack of bags 10*a, b, c, d,* etc. Corona treatment is a necessary step used to prepare the outer surface of the plastic material to received printing inks. Without corona treatment, printing inks do not satisfactorily adhere to the plastic material. The degree of corona film treatment used is within the standard range used to treat plastic material for printing, i.e. 40–46 dyne/cm. When adjacent layers of corona surface treated plastic material are cut with a wide blade, they tend to frangibly bond together.

The inventors have observed that the frangible bond strength formed, and thus the reliability of the self-opening feature of a bag pack, will not reach a maximum immediately following the manufacture of packs of self-opening bags, but will not increase to a full strength until after a few week's time. The inventors have found that the frangible bond strength can be maximized immediately to its full strength by treating the exterior surface of the plastic material of the continuous tube of plastic tube with static charging, to place a positive static charge on one exterior surface, e.g. the part which will be a front wall 18 of the bag and a negative charge on the other exterior surface, e.g. on the part which will be a rear wall 22 of the bags. As the pillowcases formed are placed in a stack, the opposite charges cause static adhesion between opposite outer walls of the stacked bags. When the bag pack 10*a, b, c, d,* etc. is cut and compress formed from statically charged material, the frangible bonding will achieve a maximum strength immediately. Static charging equipment such as offered by the Simco Company, Inc. of Hatfield, Pa., functions well. The spacing between the charging bars used to positively or negative charge the plastic material and the plastic sheet material, and the voltage delivered to the changing bars must be adjusted so that the static charge placed on the material will be present just on the outer surfaces of the plastic material, without penetrating too deeply into the plastic material, otherwise adjacent front and rear walls of bag material in each bag will be attracted together, and opening of each plastic bag will become difficult.

The central tab slit 40 and its adjacent frangible bonds 46 are formed by compressing adjacent layers of the conventionally corona treated plastic material together with a wide knife blade under normal cutting pressure, to thus form the frangible cold pressure bonds 46 between adjacent layers of the stacked bags 10*a* and 10*b*, 10*b* and 10*c*, etc. As will be discussed further below, this process is preferably carried out during the die cutting step of making the pack of bags.

The manufacturing process used to manufacture the stack of bags 10*a, b, c, d,* etc. of the invention is basically the same as is used to manufacture typical T-shirt bags which use a plastic material which has preferably been exposed to corona surface treatment on the outside wall surfaces of the bags, and which can also be statically charged.

The type of plastic material used, i.e. LDPE, HDPE, etc., and its thickness, may require slight adjustments in the width of uncut areas 44 straddling the ends 42 of the central tab slit 40 in the pack of bags 10*a, b, c, d,* etc. used with the bagging rack 56 since different plastic and polyolefin materials will tend to have different degrees of frangible bonding strength.

Figure 7:
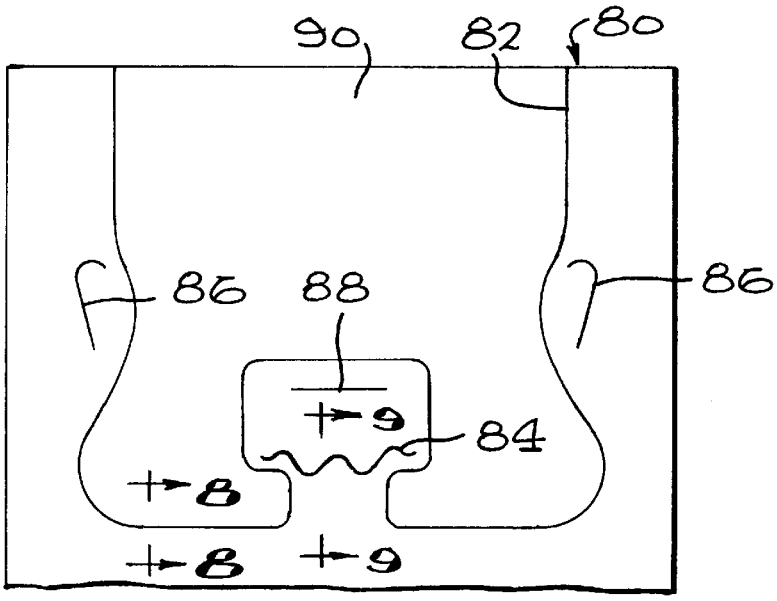
FIG. 7 is a top plan view of a die used to cut and form the pack of bags from a stack of pillowcases.
Figure 9:
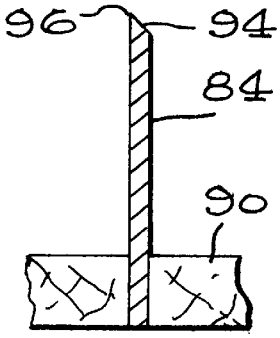
FIG. 9 is a cross-sectional view through lines 9—9 of FIG. 7, showing the cutting blade used to form the frangible bonds on the lower edge of the central tab slit.
Figure 8:
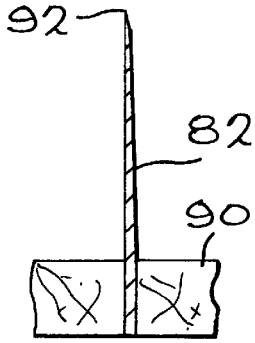
FIG. 8 is a cross-sectional view through lines 8—8 of FIG. 7, showing the cutting blade used to form the outlines of the bag handles and mouth and central tab regions.

Referring now to FIGS. 7–9, the die 80 used to form the pack of self-opening bags 10*a, b, c, d,* etc. is shown. The die consists of blade portions 82, 84, 86 and 88. The blade portions 82, 84, 86 and 88 are permanently mounted to a backing plate 90 which can comprise plywood or other materials. Blade portion 82 is used to cut the handles 14, mouth area 16 and the central mounting tab 28 which extends above the mouth area 16. Blade portion 84 is used to cut the central tab slit 64. Blade portions 86 are used to cut the handle apertures 32, and blade portion 88 is used to cut the central mounting aperture 50. FIG. 8 is a cross-sectional view of the blade portion 82 with its rear region imbedded in the backing plate 92, which can be plywood, plastic or other materials. The blade portion has a sharp front cutting edge 92 which is relatively thin to cleanly cut through the bag pack 10*a, b, c, d,* etc.

Referring to FIG. 9, the blade portion 84 is wider than blade portion 82, and has a cutting surface 94 which is relatively shallowly slanted. The cutting edge 96 cuts through the bag pack 10*a, b, c, d,* etc. and the cutting surface 94 is responsible for creating the area of the frangible bonding 46 on the lower edge of the central tab slit 40.

Figure 10:
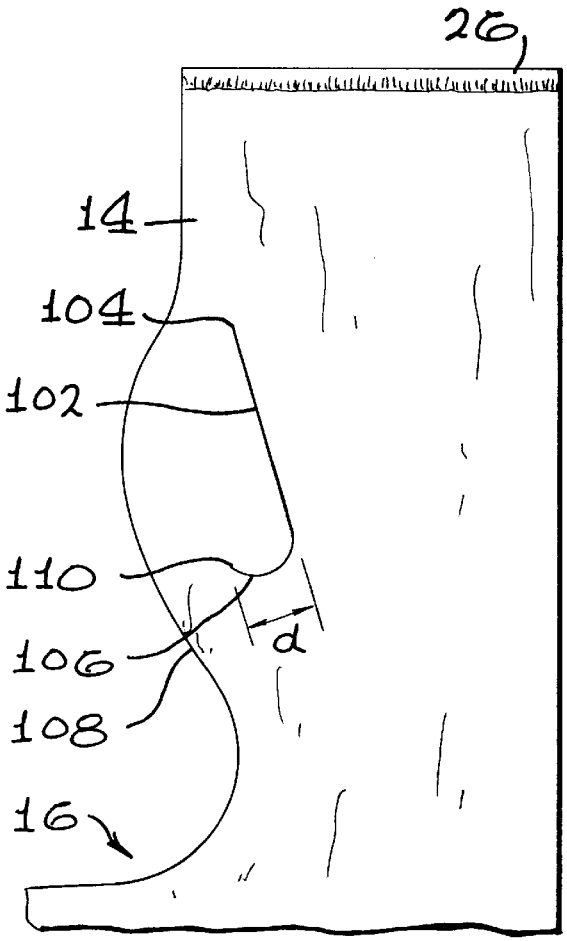
FIG. 10 is a top plan view of an alternate embodiment of the "J"-shaped handle aperture.

Referring to FIG. 10, an alternate embodiment of handle aperture 100 is shown. It is a generally "J"-shaped (rather than the inverted "J"-shaped of the first embodiment of FIG. 3). It has a generally straight line portion 102 with an upper, terminal end portion 104, and a lower curved portion 106. The straight line portion 102 preferably is slanted toward the inside edge 108 of the handles 14. The lower curved portion 106 curves up and toward the inside edge 108 of the handles 14. The terminal end 110 of the tangent line at the lower curved portion 106 is directed either generally horizontally, or slightly upwardly. The width "d" of the lower curved portion 106 is generally narrow, but permits easy loading of bag pack 10*a, b, c, d,* etc. on a variety of different bagging racks.

Referring to FIG. 6, the bag pack 10*a, b, c, d,* etc. is placed on bagging rack 74, with its mounting aperture 50 hooked on the central mounting tab hook 72. As groceries and other merchandise are placed in the front, open bag 10*a,* the weight of these goods will create a downward pulling tension on rear wall 22 of the open front bag 10*a*. This places tension on the uncut areas 44 on both sides of the central tab slit 40, which causes just the uncut materials 44 of the rear wall 22 of the frontwardly bag 10*a* and the front wall 18 of a rearwardly lying bag 10*b* to tear through. The elongate shape of the central tab slit 40 acts to relieve tension along its lower edge in the frangibly bonded area 46 formed below the central tab slit 40. This reduction in tension helps concentrate the pulling force necessary to break the uncut regions 44 before acting on the frangible bonds 46, thus ensuring that the self-opening feature is retained. The area of frangible bonding 46 further acts to hold the layers of bag together as the frontmost bag is removed from the bagging rack, and causes the bag to open relatively widely, to ready it for loading with merchandise.

Referring to FIGS. 5 and 6, after loading a new pack of bags 10*a, b, c, d,* etc. on the bagging rack 74, the checkout clerk or box boy first grasps only the front wall 18 of the frontmost bag 10*a* and pulls it forward to open the mouth 16 of the bag 10*a*. The front wall 18 only of the top bag 10*a* will be torn free from the pack of bags 10*a, b, c, d,* etc. at its central tab portion 28 along its central tab slit 34 and its uncut portion 44, and the rear wall 22 of the bag 10*a* will stay attached to the hook 72 the central tab portions 28 at its uncut portions 44. The checkout clerk or box boy then pulls the frontmost bag 10*a* forward on the forwardly extending arms 76 to free the loaded bag 10*a* and to prepare the next bag 10*b* for loading. As the frontmost bag 10*a* is loaded with merchandise, the weight thereof tends to put tension on the rear wall 22. As explained above, this tension tears the uncut material 44 of the rear wall 22 of the frontmost bag 10*a* and the front wall 18 of the following bag 10*b*. After the frontmost bag 10*a* is loaded with merchandise, its handles 14 are removed from the forwardly extending arms 76, and the loaded bag 10*a* is removed from the bagging rack 74. This action causes only the front wall 18 and side wall 20 of the next bag 10*b* in the stack of bags 10*a, b, c, d,* etc. to be pulled forward to open bag 10*b* without the checkout clerk or box boy needing to grasp the material of the top wall 18 of the bag 10*b*.

Even if the uncut regions 44 are not torn through when the bag 10*a* is loaded with merchandise, when the forward lying bag 10*a* is pulled forward to remove it from a bagging rack 54, most of the forward pulling tension will be delivered along the top edges 79 of the bags' mouth 16 to uncut areas 44 at both sides of the central tab slit 40, thereby tearing through uncut areas 44. However, because of the frangible bonding 46 of the rear and front layers 18 and 22 of adjacent bags 10*a* and 10*b* below the bottom edge of the central tab slit 40, the action of pulling the top bag 10*a* will also pull forward of the front wall 18 of the immediately following bag 10*b,* resulting in the next bag 10*b* in the pack opening up. Thereafter, by merely withdrawing consecutive bags from the top of the pack of bags 10*a, b, c, d,* etc., the bag immediately following will open up without the clerk or box boy needing to grasp just the top layer of material 18 of the bag 10*b*. The shapes of the central tab slit 40 assists in this mechanism since it is longer than the straight line distance between its end points 42, which tends to relieve tension on the frangible bonds 46.

As can be appreciated, the pack of bags 10*a, b, c, d,* etc. can be manufactured by a simple and reliable method of manufacture.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A pack of bags for use with a variety of different sized bagging racks, comprising:

a plurality of bags, each of said bags having opposed walls with outer surfaces, and each bag being aligned in a stack, said opposed walls being closed at a bottom edge and at least partially openable at a top region to define a mouth region;

a central tab portion being located on said opposed walls of each of said bags and extending above said mouth region of said bags, said central tab portion having a central tab slit extending thereacross except for narrow uncut portions adjacent side edges of said central tab portion, said central tab slit being formed through said stack of bags;

a pair of handles extending upwardly from both sides of the mouth, each of said handles having a "J"-shaped handle aperture formed therethrough and adapted for use in mounting the bag pack on a bagging rack by passage of suspension arms of the bagging rack through the "J"-shaped handle apertures, wherein each "J"-shaped handle aperture consists of a slit which has a curved portion at one end which curves toward an inner edge of the handle and a generally straight and elongate portion.

2. The pack of bags for use with a bagging rack of claim 1, wherein each said "J"-shaped handle aperture is oriented with its curved portion above said generally straight and elongate portion.

3. The pack of bags for use with a bagging rack of claim 1, wherein each said "J"-shaped handle aperture is oriented with its curved portion below said generally straight and elongate portion.

4. The pack of bags for use with bagging rack of claim 1, wherein said generally straight and elongate portion of the slit slants slightly inwardly toward the inner edge of said handles.

5. The pack of bags for use with bagging rack of claim 1, wherein said walls of said pack of bags are held together by frangible bonds located directly adjacent a lower edge of said central tab slit passing through said central tab portions.

6. The pack of bags for use with bagging rack of claim 1, wherein said central tab portions in said pack of bags are heat sealed together above said tearing cut to form said pack of bags.

7. The pack of bags for use with a bagging rack of claim 1, wherein said central tab portion has a neck region which extends above the mouth region and a head region extending above said neck region, and wherein the central tab portions of adjacent bags are frangibly bonded together.

8. The pack of bags for use with a bagging rack of claim 7, wherein said central tab slit has terminal ends adjacent side edges of the central tab portion in said head region and a central portion which follows a generally downwardly directed path.

9. The pack of bags for use with a bagging rack of claim 7, wherein said central tab slit has terminal ends adjacent side edges of the central tab portion in said head region and a central portion which follows a generally downwardly directed and generally sinusoidal path.

10. The pack of bags for use with a bagging rack of claim 7, wherein said central tab slit has terminal ends adjacent side edges of the central tab portion in said head region and a central portion which follows a generally downwardly directed and generally zigzag path.

11. The pack of bags of claim 1, wherein said central tab portion further comprise a central mounting aperture above said central tab slit, said central mounting aperture being engageable with a hook positioned on a bagging rack.

12. The pack of bags of claim 1, wherein said uncut portions of said central tab are in the range of 1 to 3 millimeters wide.

13. The pack of bags of claim 1, wherein said bags are pleated.

14. The pack of bags of claim 1, wherein said central tab slit is about 10 percent or greater in length than the straight line distance between its endpoints.

15. The pack of bags of claim 5, wherein the frangible bonds adjacent the central tab slit is formed by cutting the central tab slit with a generally wide cutting blade with a shallow slated cutting edge.

16. The pack of bags of claim 5, wherein said pack of bags is formed from plastic material which has been at least partially corona discharge treated.

17. The pack of bags for use with a bagging rack of claim 5, wherein said pack of self-opening bags is formed from plastic material which has been treated by placing a first static charge on one of the opposed wall and an opposite static charge on the other of the opposed wall, the static charges enhancing frangible adhesion between adjacent bags in the pack of bags.

18. A pack of bags for use with a variety of bagging racks, comprising:

a plurality of bags, each bag having a front wall and a rear wall;

side walls joining said front and rear walls, said bags having a bottom edge which is closed and a partially opened top edge;

a pair of integral handles extending upwardly from said top edge with a mouth region located between said integral handles, said integral handles having elongate "J"-shaped apertures formed therethrough and adapted for passage of suspension arms of a bagging rack to carry said handles on the bagging rack; and central tab portions located on said front and rear walls in said mouth region of said bags, said central tab portions having a neck region which extends above said mouth region and a head region which is wider than the neck region and which extends above said neck region, an aperture for receiving a retaining hook of the bagging rack, and a central tab slit which extends across said central tab portion above an interface region between said neck region and said head region, except for uncut portions adjacent said side edges of said central tab portion on said head portion, said central tab slit being located below said aperture, said pack of bags being frangibly bonded together along the bottom edge of said central tab slit which passes through said central tab portions.

19. The pack of bags for use with a bagging rack of claim 18, wherein each said "J"-shaped handle apertures consists of a slit which has a curved portion at one end which curves toward an inner edge of said handles and a generally straight and elongate portion.

20. The pack of bags for use with bagging rack of claim 19, wherein said generally straight and elongate portion of the slit slants slightly toward the inner edge of said handles.

21. The pack of bags for use with bagging rack of claim 18, wherein each said "J"-shaped handle aperture is oriented with its curved portion above said generally straight and elongate portion.

22. The pack of bags for use with bagging rack of claim 18, wherein each said "J"-shaped handle aperture is oriented with a curved portion below a generally straight and elongate portion.

23. The pack of bags for use with bagging racks of claim 18, wherein said bags are formed of a plastic material which has been corona surface treated on at least portions of outer surfaces of said front and rear walls.

24. The pack of bags of claim 18, wherein said central tab portions are attached together by heat sealing.

25. The pack of bags of claim 18, wherein said uncut portions of said central tab portions are in the range of 1 to 3 millimeters wide.

26. The pack of bags of claim 18, wherein the frangible bonding located on the lower edge of the central tab slit is formed by cutting the central tab slit with a generally wide cutting blade with a shallow slanted cutting edge.

27. The pack of bags for use with a bagging rack of claim 18, wherein said central tab slit has terminal ends adjacent side edges of the central tab portion in said head region and a central portion which follows a generally downwardly directed path.

28. The pack of bags for use with a bagging rack of claim 18, wherein said central tab slit has terminal ends adjacent side edges of the central tab portion in said head region and a central portion which follows a generally downwardly directed and generally sinusoidal path.

29. The pack of self-opening bags of claim 18, wherein said pack of bags is formed from plastic material which has been at least partially corona discharge treated.

30. The pack of bags for use with a bagging rack of claim 18, wherein said pack of self-opening bags is formed from plastic material which has been statically charged with a first charge on one of the front and rear walls and an opposite charge on the other of the front and rear walls so the outer surface of said front and rear walls of adjacent stacked bags statically cling to the front and rear walls of other, adjacent bags so that during manufacturing of said pack of bags, more reliable frangible bonding can be formed.

* * * * *